United States Patent [19]

Negaty-Hindi et al.

[11] Patent Number: 4,756,450

[45] Date of Patent: Jul. 12, 1988

[54] DISPENSER OF DRINKS CAPABLE OF RELEASING GAS IN SOLUTION

[75] Inventors: Guy Negaty-Hindi, Onex; Yves Trouilhet, Vesenaz; Norbert Koblet, Meyrin, all of Switzerland

[73] Assignee: Battelle Memorial Institute, Columbus, Ohio

[21] Appl. No.: 855,614

[22] PCT Filed: May 8, 1985

[86] PCT No.: PCT/CH85/00076

§ 371 Date: Mar. 4, 1986

§ 102(e) Date: Mar. 4, 1986

[87] PCT Pub. No.: WO86/00609

PCT Pub. Date: Jan. 30, 1986

[30] Foreign Application Priority Data

Jul. 4, 1984 [CH] Switzerland ..... 3224/84

[51] Int. Cl.[4] ..... B65D 35/30

[52] U.S. Cl. ..... 222/95; 222/105; 222/340; 222/391

[58] Field of Search ..... 222/95, 94, 96, 105, 222/107, 131, 183, 327, 340, 341, 386, 391, 387, 386.5; 188/67

[56] References Cited

U.S. PATENT DOCUMENTS

| | | | |
|---|---|---|---|
| 1,747,505 | 2/1930 | Emmert | 188/67 |
| 2,491,259 | 12/1949 | Funderburg | 222/386 X |
| 2,806,385 | 9/1957 | James | 188/67 |
| 3,235,138 | 2/1966 | Bull | 222/340 X |
| 3,938,706 | 2/1976 | Cohen | 222/83.5 |
| 3,951,310 | 4/1976 | Steiman | 222/340 X |
| 4,136,802 | 1/1979 | Mascia et al. | 222/95 |
| 4,264,019 | 4/1981 | Roberts et al. | 222/95 |
| 4,330,070 | 5/1982 | Doubleday | 222/391 X |

FOREIGN PATENT DOCUMENTS 817981 10/1951 Fed. Rep. of Germany .

*Primary Examiner*—Robert J. Spar
*Assistant Examiner*—P. McCoy Smith
*Attorney, Agent, or Firm*—Cushman, Darby & Cushman

[57] ABSTRACT

The dispenser comprises a flexible sealing-tight vessel (1) disposed in a rigid chamber (3) containing a ratchet mechanism comprising ratchet teeth (6) secured to a tubular element (4) and pawls (11) on resilient arms (10) mounted on a disc (9) disposed above the flexible bag (1). Resilient elements (12) fastened to the disc (9) lower it in proportion as a drink is withdrawn from the flexible bag (1). The ratchet mechanism retains the disc (9) when the pressure in the bag (1) becomes higher than atmospheric pressure.

6 Claims, 2 Drawing Sheets

DISPENSER OF DRINKS CAPABLE OF RELEASING GAS IN SOLUTION

The invention relates to a dispenser of drinks capable of releasing gas in solution at atmospheric pressure, the dispenser comprising a vessel, at least one wall portion of which is deformable in proportion as the drink is dispensed, the vessel being disposed in a chamber having a wall dimensioned to withstand the pressure in the vessel after release of the gas and comprising means preventing the volume of the vessel increasing through the increase in pressure after the drink has been dispensed.

Flexible vessels have already been proposed for transporting non-aerated drinks, more particularly wine, and have commonly replaced the small casks formerly used for delivering wine in bulk for bottling by private individuals.

In the case of drinks capable of outgassing at ambient pressure, this packaging can be used only if the flexible vessel is disposed in a rigid chamber and means are provided for keeping the flexible vessel wall at a volume which constantly corresponds to that of the liquid, to prevent the drink from outgassing.

For example it has been proposed, inter alia in U.S. Pat. No. 4,264,019, to use water to fill the space left free between the flexible vessel and the rigid chamber as the drink is dispensed, a valve being provided for the purpose. This solution has a number of disadvantages. It needs a source of water under pressure, which is not always available e.g. at a picnic or camp-site. The rigid chamber has to be sealing-tight to hold the water surrounding the flexible vessel.

A resilient element cannot be used, since the force to be exerted on the flexible vessel walls varies substantially depending on whether the aerated liquid is being withdrawn. When the drink is withdrawn the pressure drops progressively, so that the force to be exerted on the flexible vessel walls to reduce the volume left free by the withdrawn drink is small and decreases to zero or negative values depending on the volume withdrawn. When on the other hand the vessel is hermetically sealed, the liquid outgasses until the pressure rises to about 1.1 to $3\times10^5$ Pa. If a resilient element is used it will flex until equilibrium is obtained, resulting in some increase in the volume of the vessel and a corresponding reduction in the volume of gas. Spring pressure also decreases as the vessel empties. In the case of a spring element the spring pressure is added to that of the liquid, so that when the vessel is full the pressure may be excessively high.

The solution proposed by U.S. Pat. No. 4,136,802 solves the problem of the variable spring force but is not of use for dispensing a gassy drink, in view of the considerable pressures which may occur in the vessel.

In U.S. Pat. No. 3,938,706 it has been proposed to place a flexible bag in a vessel having rigid walls with an end adapted to move axially inside the side wall of the vessel. The side wall is joined to the end by ratchet teeth formed on the inner surface of the side wall and resilient lugs secured to the end and engaging the teeth. The flexible bag is not designed to hold a liquid capable of outgassing. Manual pressure is exerted on the end to produce pressure in the flexible bag for ejecting the product.

The invention aims to provide a solution which has the advantages but is free from the disadvantages of using an incompressible fluid to fill the space released by withdrawal.

To this end, the invention relates to a drink-dispensing vessel according to claim 1.

The advantage of the proposed solution is that it is simple and the vessel according to the invention is completely self-contained, i.e. can be used at any place and therefore under any circumstances. In contrast to "multi-packs" of aerated drinks, the vessel according to the invention can reduce the weight, volume and price of packaging while retaining the gassy properties of the drink. This solution, therefore, has exactly the same technical advantages as the use of an incompressible fluid to fill the space between the flexible vessel and the rigid chamber.

An embodiment and a variant of the drink-dispensing vessel according to the invention are shown diagrammatically by way of example in the accompanying drawings, in which.

Figure 1:
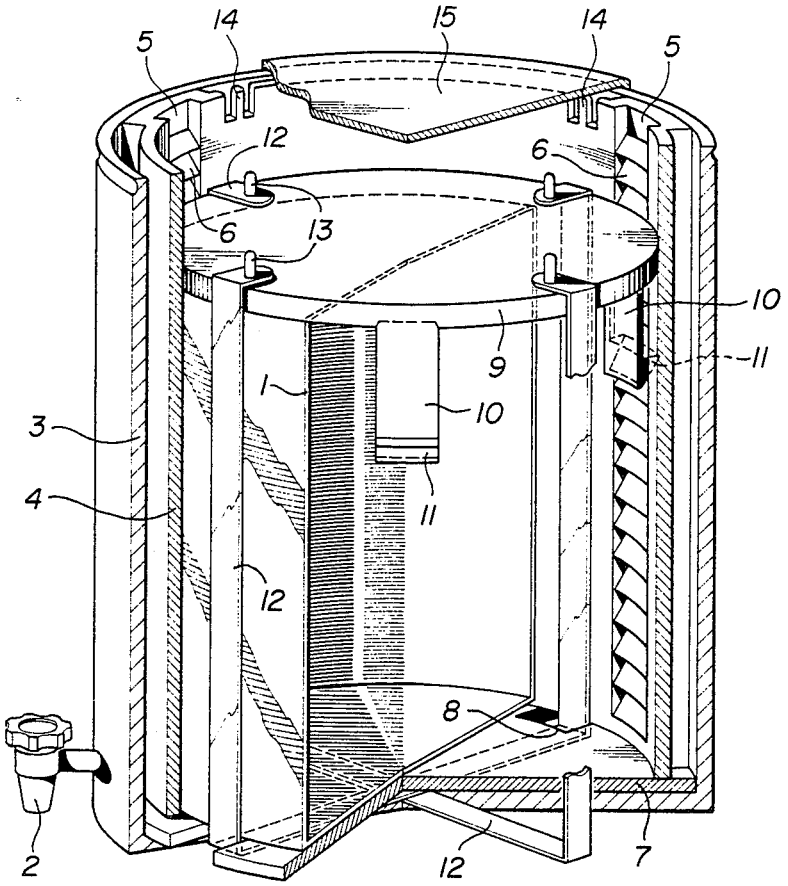
FIG. 1 is a cut-away perspective view of the embodiment.

The actual vessel comprises a flexible bag 1 made of two polyethylene sheets covered with aluminium to make them gas-tight and welded to one another at their periphery and dimensioned to contain a given volume after deformation. Bag 1 has an opening (not shown) to receive a dispensing tap 2. A chamber 3, cylindrical in the present example, has a relatively rigid wall and is used to protect bag 1 from external damage and to hold the aerated drink at an excess pressure sufficient to prevent outgassing. Advantageously the chamber wall can be of cardboard whereas the bottom and cover parts can be reinforced or made of metal and crimped on to the cardboard side wall.

In order to keep the flexible bag under pressure irrespective of the volume of liquid it contains, chamber 3 contains a ratchet mechanism comprising an injection moulded plastics tubular element 4 having a wall surrounding the flexible bag and formed with three longitudinal grooves 5 having ratchet teeth 6 at the bottom. Tubular element 4 is fitted into chamber 3 and its base rests on a disc 7 having a diameter equal to the inner diameter of chamber 3, so that disc 7 extends beyond the tubular element 4. The edge of disc 7 has four slots 8 at 90° intervals, the bottom of each slot being on a circle having a diameter smaller than that of element 4.

A disc 9 having a diameter smaller than the inner diameter of element 4 is disposed on bag 1 and closes the top end of element 4. It is used for limiting the volume of bag 1. To this end, disc 9 has three resilient tongues 10 at its periphery, each tongue having a pawl 11. When the disc is placed at the top end of element 4 so that the pawls face the longitudinal grooves 5, pawls 11 engage in the respective teeth 6.

Two resilient elements 12 in the form of rubber bands intersect under the bottom disc 7 and are positioned in slots 8. They rise between bag 1 and the inner wall of element 4 and are fastened to lugs 13 moulded on the upper surface of disc 9 and thus exert tensile force tending to push the disc along the inner wall of element 4. Disc 9 is prevented from rising again, owing to the pawls 11 engaging the teeth 6.

There are two possible methods of assembling the vessel. The first consists in inserting disc 9 into element 4 before filling bag 1. In this method of assembly, pawls 11 have to be released from teeth 6 while the drink is being introduced into the vessel. To this end, use can be made of a three-armed rod, pin or the like for releasing the three pawls 11 simultaneously.

Another solution would be to fill bag 1 with drink and insert it into element 4, or to fill it in situ before positioning the disc 9. In that case, the top of the wall of element 4 must be formed with slots 14 for temporarily fastening the resilient elements 12. When bag 1 has been placed in position, disc 9 is inserted and lowered in element 4 until it abuts the flexible bag 1, which has been filled with liquid and has become substantially cylindrical. The ends of the two resilient elements 12 are then moved past slots 14, where they were temporarily attached to lugs 13 of disc 9. Chamber 3 is closed at its top end, e.g. by a crimped cover 15.

When the dispensing tap 2 is closed, the gas dissolved in the drink escapes until the pressure in bag 1 is in equilibrium with the partial pressure of $CO_2$ in the liquid. The pressure depends on the concentration of $CO_2$ and the temperature of the drink. It is usually between $1.10^5$ and $3.10^5$ Pa for aerated drinks. When the drink is withdrawn, the reduction in volume results in a reduction in pressure, since the dissolved gas does not escape instantaneously, so that only a very weak force is needed to lower the disc 9. For this reason, ordinary elastic rubber bands are adequate. When tap 2 is closed again, the pressure progressively rises in bag 1 but at that time it is prevented from swelling only by disc 9 and teeth 6, since the resilient elements 12 are then inoperative.

Figure 2:
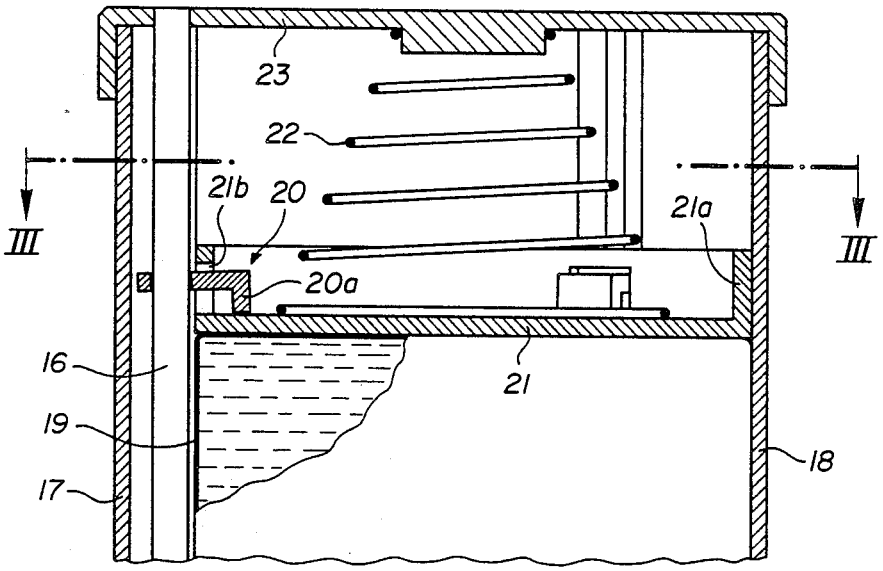
FIG. 2 is a sectional view in elevation of a variant of FIG. 1.
Figure 3:
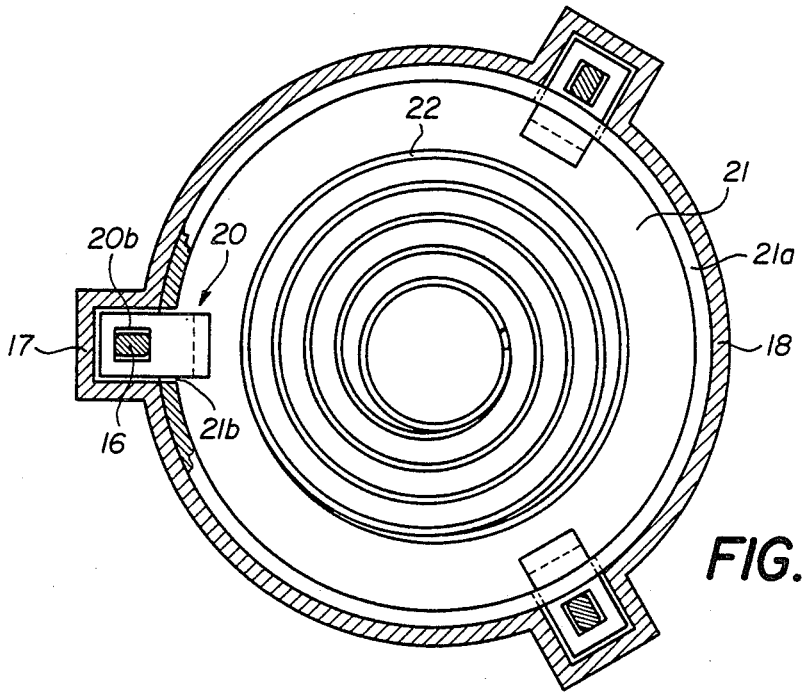
FIG. 3 is a view in section along line III—III of FIG. 2.

FIGS. 2 and 3 illustrate a variant which has some advantages over the embodiment in FIG. 1. The main difference between the variant and the embodiment in FIG. 1 is that the ratchet teeth and pawls are replaced by rods 16 disposed in lateral recesses 17 extending longitudinally towards the exterior of a tubular element 18 containing a sealing-tight flexible bag 19 for holding an aerated drink. Each rod 16 engages a locking means 20 having a cross-section in the form of an L having an arm 20*a* bearing on a piston 21 associated with a cylindrical flange 21*a* for guiding piston 21 along the wall of the tubular element. The other arm of the locking means 20 extends through an aperture 21*b* in flange 21*a* and has an aperture 20*b* through which rod 16 freely extends when the arm formed with aperture 20*b* extends perpendicular to the longitudinal axis of rod 16, whereas rod 16 is caught in aperture 20*b* when the arm is inclined to the aforementioned axis. A spring 22 is compressed between piston 21 and an end 23 secured to tubular element 18.

When the volume of bag 19 decreases after a drink enclosed therein has been dispensed, spring 22 pushes piston 21 which slides along the inner wall of element 18 and drives the locking means 20 via the top edge of aperture 21*b*. When the dispensing tap has closed again, the pressure in bag 19 increases through outgassing. The bag thereupon pushes piston 21 upwards. As soon as piston 21 starts to move, the locking means 20 bearing on piston 21 become inclined, since the pressure acts on their end remote from the end formed with aperture 20*b*. The edges of aperture 21*b* then become locked against rod 16, whereupon locking means 20 prevent piston 21 from continuing to rise. When the pressure exerted on piston 21 rises, the force exerted on means 20 increases, with a corresponding increase in the strength with which locking means 20 are locked against rods 16.

The advantages of the variant over the preceding embodiment are firstly in the resulting simplification and secondly in the increase in mechanical resistance to the pressure exerted on piston 21. This is because the replacement of resilient ratchets by rigid locking means 20 enables the resistance to be increased owing to the elimination of a resilient means which also has to resist pressure, or pawls or ratchet teeth which have to withstand high pressure and must be dimensioned accordingly. There are no ratchet teeth, thus eliminating an element which poses problems when the flexible bag is pressed against the teeth and risks being damaged.

Note that the cylindrical flange 21*a* guiding piston 21 also serves as an abutment against end 23, so that when the flexible bag is full, the pressure is not withstood by the locking means 20 but by the end 23 against which flange 21*a* abuts. Rods 16 preferably have a rectangular section with rounded corners, the major axis of the section extending radially relative to the axis of tubular element 18 so as to increase the resistance of the rods to the pressure exerted by bag 19. Advantageously the opposite surfaces of rod 16 forming the minor sides of the rectangle can be roughened by milled transverse ridges.

Although the two variants illustrated in FIGS. 1 to 3 illustrate resilient elements 12 or a spring 22 for lowering disc 9 and piston 21 respectively, these elements are only means for securing disc 9 or piston 21 to bag 1 or 19 respectively. Elements 9 and 21 can be secured to bags 1, 19 by means other than resilient elements. For example, disc 9 or piston 21 can be stuck or welded to bag 1, 19. Since the bag is filled only by an incompressible fluid (a liquid without any gas) when the liquid is withdrawn, the pressure inside the bag rapidly falls to atmospheric pressure and, since the volume of dispensed liquid is not replaced by gas, the volume of the bag decreases by an amount corresponding to that of the withdrawn liquid. Consequently, if disc 9 or piston 21 is secured to the bag wall, it is driven thereby owing to the reduction in the volume of liquid in the bag.

We claim:

1. A dispenser of drinks capable of releasing gas in solution at atmospheric pressure, the dispenser comprising:

a flexible bag, said bag having at least one wall portion which is deformable in proportion as the drink is dispensed;

a housing for receiving said bag;

means for preventing an increase in the volume of said flexible bag through the increase in pressure after the drink has been distributed, including a movable disc secured to the deformable portion of said flexible bag;

at least one resilient element operatively coupled to said movable disc for exerting a compressive force on said bag for reducing the volume of said flexible bag; and a locking element connecting said movable disc to a fastening element secured to the housing, said locking element being adapted to follow said disc when said disc is moved as a result of a decrease in the volume of the liquid, and to be secured to said fastening element when the opposing force built up in the bag as a result of the outgassing of the drink is greater than the force of said at least one resilient element; wherein said fastening element is a rod and said locking element has an opening dimensioned so as to move freely along said rod when the axis of the opening substantially coincides with the axis of said rod, said locking element having a cross-section in the form of a L with one end resting on said movable disc at a distance from the opening so as to move an axis of said locking element through an angle relative to the rod axis when the movable component tends to move as a result of an increase in pressure in the vessel.

2. A dispenser according to claim 1, wherein said movable disc comprises an element for guiding the locking component when moved by the resilient element.

3. A dispenser according to claim 1, wherein said at least one resilient element comprises resilient means operatively coupled to said movable disc so as to subject said movable disc to a force which secures it to that portion of the bag wall against which it is pressed.

4. A dispenser of drinks capable of releasing gas and solution at atmospheric pressure, the dispenser comprising:

a hermetically sealed flexible vessel, at least one wall portion of said vessel being deformable in proportion as the drink is dispensed a housing for receiving said vessel;

means for following the movement of said wall portion and for preventing the volume of the sealed vessel from increasing through the increase in pressure after the drink has been distributed, said means for following including a movable disc component secured to the deformable portion, a locking element for engaging fastening element secured to said housing and at least one resilient element for exerting a force in order to reduce the volume of said sealed vessel, said locking component being adapted to follow said movable disc component when moved as a result of a decrease in the volume of the liquid, and being adapted to be secured to said fastening element when an opposing force built up in the vessel as a result of the outgassing of the drink is greater than the force of said at least one resilient element; wherein said fastening element is a rod and said locking element has an opening dimensioned so as to move freely along said rod when the axis of the opening substantially coincides with the axis of said rod, said locking element having a cross-section in the form of a L with one end resting on said movable disc at a distance from the opening so as to move an axis of said locking element through an angle relative to the rod axis when the movable component tends to move as a result of an increase in pressure in the vessel.

5. A dispenser according to claim 4, wherein said movable disc comprises an element for guiding the locking component when moved by the rsilient element.

6. A dispenser according to claim 4, wherein said at least one resilient element comprises resilient means operatively coupled to said movable disc so as to subject said movable disc to a force which secures said disc to that portion of the vessel wall against which it is pressed.

* * * * *